US005884432A

United States Patent [19]

DeLillo

[11] Patent Number: 5,884,432

[45] Date of Patent: Mar. 23, 1999

[54] BREAKAWAY ASSEMBLY FOR VEHICLE BARRIER DEVICE

[76] Inventor: Michael J. DeLillo, 15510 Sunset Blvd., #204, Pacific Palisades, Calif. 90272-3529

[21] Appl. No.: 953,573

[22] Filed: Oct. 17, 1997

[51] Int. Cl.[6] ..... E01F 13/00

[52] U.S. Cl. ..... 49/49

[58] Field of Search ..... 49/49; 403/2; 105/341; 52/98, 99

[56] References Cited

U.S. PATENT DOCUMENTS

| | | | |
|---|---|---|---|
| 1,628,651 | 5/1927 | Burress . | |
| 2,137,193 | 11/1938 | Stafford . | |
| 3,686,794 | 8/1972 | Sakamoto et al. | 49/141 |
| 3,791,072 | 2/1974 | Miller | 49/141 |
| 4,071,970 | 2/1978 | Strizki | 403/2 X |
| 4,105,350 | 8/1978 | O'Donnell | 52/98 X |
| 4,364,200 | 12/1982 | Cobb | 49/192 |
| 4,490,062 | 12/1984 | Chisholm | 403/2 |
| 4,655,002 | 4/1987 | Everson | 49/246 |
| 4,811,516 | 3/1989 | Anderson | 49/49 |
| 5,125,194 | 6/1992 | Granger | 52/98 |
| 5,214,886 | 6/1993 | Hugron | 52/98 |
| 5,442,878 | 8/1995 | Flores | 49/208 |
| 5,484,217 | 1/1996 | Carroll et al. | 403/2 |
| 5,653,058 | 8/1997 | Zaimins | 49/49 X |
| 5,671,563 | 9/1997 | Marcum | 49/49 |

*Primary Examiner*—Jerry Redman
*Attorney, Agent, or Firm*—Christie, Parker & Hale, LLP

[57] ABSTRACT

A breakaway assembly comprises a first assembly member adapted for connection at one of its ends with a movable member of a vehicle barrier device, and a second assembly member adapted for connection at one of its ends with a gate arm of the vehicle barrier device. A breakable member is releasibly connected at one of its ends to the first assembly member, and is releasibly connected at an opposite one of its ends to the second assembly member. The breakable member is constructed so that it preferentially breaks between the first and second assembly members in response to a determined impact force imposed on the gate arm to spare the gate arm from serious damage, to ease and expedite repair operations, and to reduce the costs associated with maintaining and adequate inventory of replacement parts.

16 Claims, 3 Drawing Sheets

12
20
22
24
26
28
30
32
34
36
38
40
42
44
45
46
48
50
52
54
57

BREAKAWAY ASSEMBLY FOR VEHICLE BARRIER DEVICE

FIELD OF THE INVENTION

This invention relates to an assembly adapted for use with a rigid member to give way in response to a contact against the rigid member and, more specifically, to an assembly incorporated into a vehicle barrier gate arm that is designed to preferentially break away when the gate arm is struck by a passing vehicle, that can be adapted to activate an alarm when broken, and that is designed to be repaired in an easy and time efficient manner.

BACKGROUND OF THE INVENTION

The use of vehicle barrier devices having a gate arm to control the passage of vehicles thereby is well known and is used in such applications as parking lots and garages, gated communities, highway toll plazas and the like. A typical vehicle barrier device is one having a gate arm that is mechanically operated, either automatically or by an attendant, to permit the passage of a vehicle thereby by raising the gate arm from a horizontal position across the front of the vehicle to a vertical position out of the path of the vehicle. The gate arm itself is typically made from a suitable rigid structural material such as wood and the like. Wooden gate arms are traditionally preferred because of their relatively low cost.

It is not uncommon for the gate arm of such device to be broken by contact with a vehicle, that has passed by the device when the gate arm was in a lowered position. When this occurs, the device must be repaired in order to continue serving as a vehicle barrier. The repair operation usually consists of replacing the gate arm with a new gate arm, however, can consist of bracing the broken portion of the existing gate aim. In either case, the repair requires that either a new gate arm be available to replace the broken gate arm, or that materials be readily available to brace the existing broken gate arm.

In most cases, the device operator does not have a replacement new gate arm or adequate repair materials in their immediate inventory due to the cost associated with such an undertaking. Therefore, the operator must order the replacement gate arm from the device manufacture, which can take weeks depending on its inventory and geographical location. During this period of time the device is unable to serve as a vehicle barrier, thereby allowing vehicle to pass freely through the otherwise controlled area. This can present both a security risk, in those applications where the device functions to permit the passage of only authorized vehicles into an otherwise secure area such as a gated community, and result in a loss of revenue, in those applications where the device functions to permit the passage of vehicles after a parking fee or toll is collected such as a parking lot or garage, or a highway toll booth.

Once the replacement gate arm is obtained, the replacement or repair operation is often time consuming and can require the assistance of more than one person. The replacement or repair operation also requires that the device be taken out of service and usually that the vehicle path by the device be blocked for some period of time during the operation.

It is, therefore, desirable that a device be constructed that is adapted for use with a vehicle barrier device to spare a gate arm of the device from serious damage when contacted by a passing vehicle. It is desired that the device be constructed in a manner that facilitates an easy and rapid repair after a gate arm has been struck and rendered inoperable by a passing vehicle. It is also desirable that the device be constructed so that any replacement part be both small in size, to facilitate easy and space efficient storage, and enable the repair operation to be carried out by one person by hand and without the need for tools.

SUMMARY OF THE INVENTION

A breakaway assembly, prepared according to principles of the invention, is adapted for use with a vehicle barrier device having a gate arm. The breakaway assembly comprises a first assembly member that is adapted to be connected at one of its ends with a movable member of a vehicle barrier device, and a second assembly member that is adapted to be connected at one of its ends with a gate arm of the vehicle barrier device. A breakable member is releasibly connected at one of its ends to the first assembly member, and is releasibly connected at an opposite one of its ends to the second assembly member. The breakable member is constructed so that it preferentially breaks between the first and second assembly members in response to a determined impact force imposed on the gate arm to spare the gate arm and gate controller from serious damage.

The breakaway assembly of this invention is designed to be easily repaired once the breakable member is broken, without the need for any tools or without the need for assistance by another, and is designed to enable a rapid repair, avoiding the need to render the vehicle barrier device inoperable for any significant amount of time. Further, the design of using a sacrificial breakable member makes storage of the necessary replacement part easy and space efficient, and reduces the cost associated with maintaining a sufficient inventory of replacement parts.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

A breakaway assembly, constructed according to principles of this invention, is adapted for connection within a vehicle barrier device having a gate arm and includes a removable breakable member that is interposed between connected gate arm portions, and that is adapted to be preferentially broken when a sufficient impact force is imposed on the gate arm. Constructed in this manner, the breakaway assembly is designed to be broken upon sufficient impact force imposed on the gate arm, thereby saving the gate arm from serious damage. Additionally, the breakaway assembly is designed so that the breakable member can be easily and rapidly replaced, thereby minimizing operational downtime of the vehicle barrier device.

Figure 1:
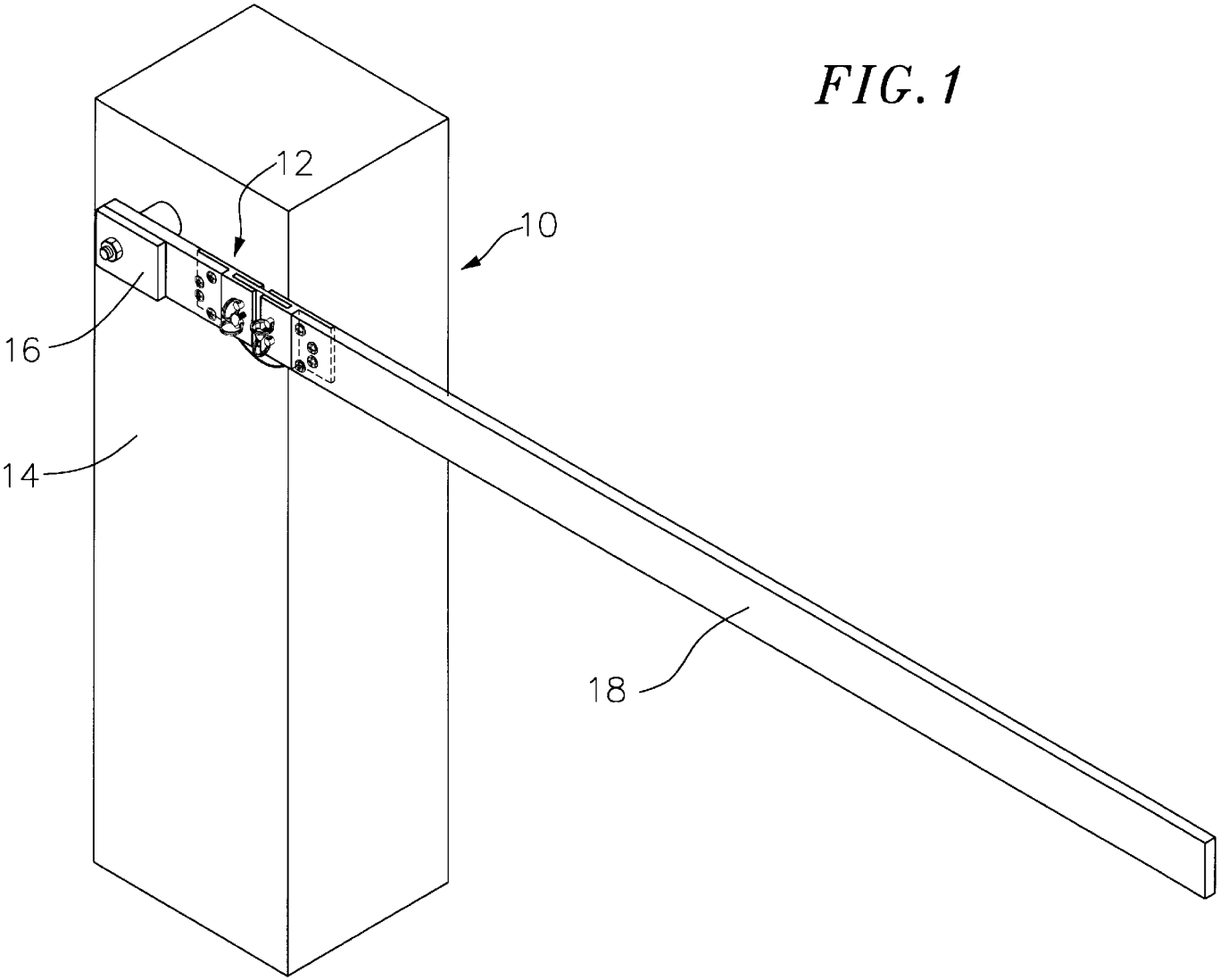
FIG. 1 is a perspective view of a vehicle control device comprising a gate arm having a breakaway assembly constructed in accordance with the practice of the present invention installed therein.

FIG. 1 illustrates a vehicle barrier device 10 that includes a breakaway assembly 12 of this invention. The vehicle barrier device 10 includes an operating mechanism or controller housing 14 and a movable gate arm attachment means 16 extending from the housing 14. The operating mechanism for the device 10 can be of conventional gear or belt-driven design that is adapted to cause the attachment means 16 to rotate in a clockwise direction to raise the gate arm, or a counter-clockwise direction to lower the gate arm, by electric motor operation that is either automatically actuated or actuated by operator input. Alternatively, the operating mechanism for the device 10 can be one that is operated manually, i.e., without the use of an electric motor and the like, by action of the operator.

The breakaway assembly 12 is connected to the gate arm attachment means 16 at one of its ends, and is attached to a gate arm 18 at an opposite one of its ends. It is desired that the breakaway assembly 12 be connected to the vehicle barrier device 10 at a position that is close to the attachment means 16 so that a sufficient force will be imposed on the breakaway assembly 12 to cause it to break away when the gate arm is impacted by a passing vehicle, thereby saving the gate arm itself from serious damage.

Figures 2, 3:
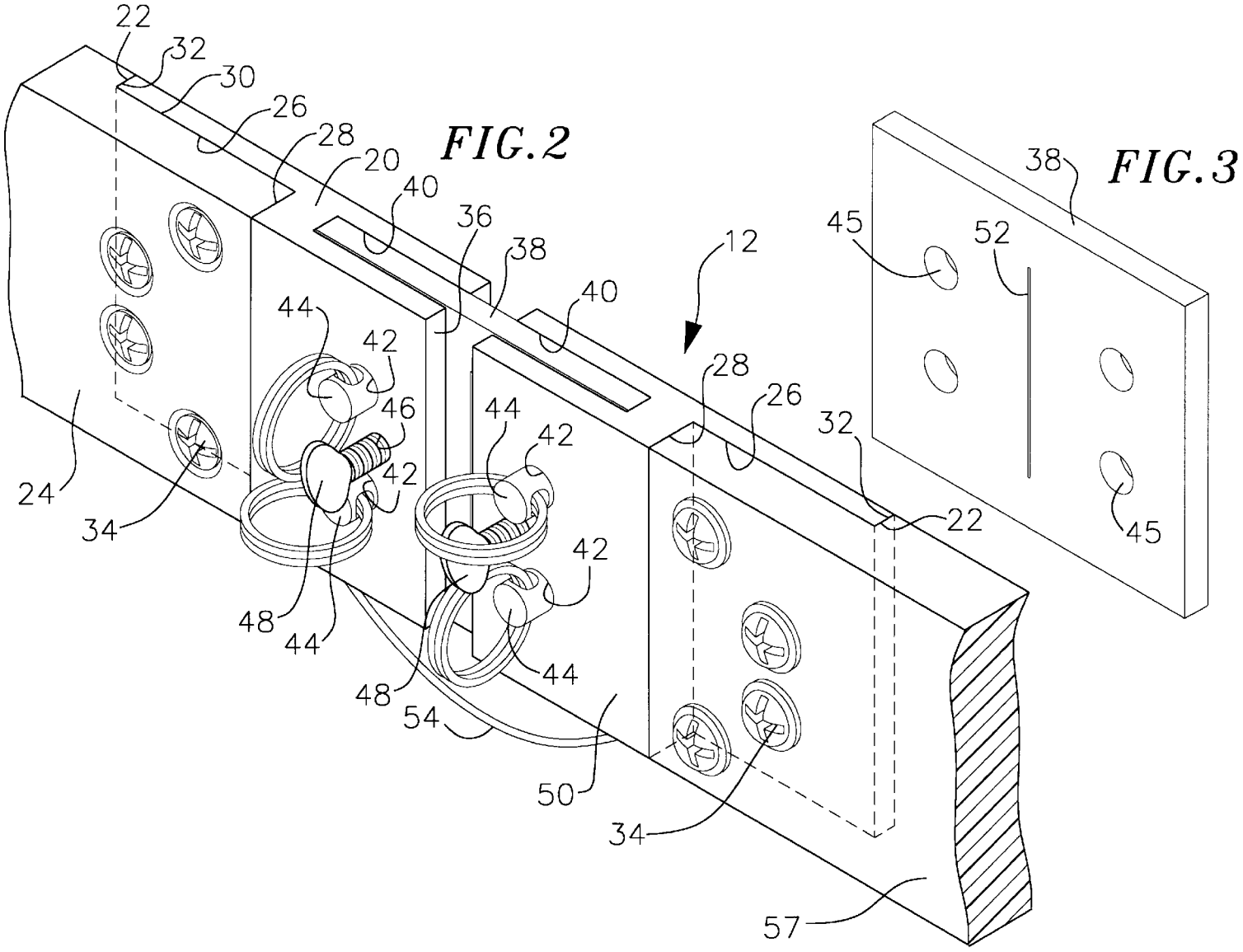
FIG. 2 is a perspective view of the breakaway assembly in FIG. 1 constructed in accordance with the practice of the present invention.
FIG. 3 is a perspective view of a breakable member for use with the breakaway assembly of FIG. 1.

FIG. 2, illustrates an example embodiment of the breakaway assembly 12 removed from the vehicle barrier device and gate arm. The assembly 12 comprises a first member 20 having a first end 22 that is adapted for attachment to an arm base 24. The first member 20 has a rectangular geometric shape that is selected to complement the structure of the gate arm and arm base 24. The first member 20 is formed from a structurally rigid material that is suitable for withstanding a load imposed by a gate arm. Suitable materials for forming the first assembly member include metals and metal alloys. A preferred material is aluminum due to its desirable combination of structural rigidity and strength and light weight.

Moving from left to right in FIG. 2 from the first end 22, the first member 20 includes a cut out portion 26 that extends a distance there along and includes a shoulder 28 at a transition point from the cut out portion 26 to the remaining portion of the first member. The cut out portion 26 is designed to accommodate placement of the arm base 24 therein. It is desired that the arm base 24 include a complementary cut out portion 30 and shoulder 32 to ensure that the arm base fits securely against the first member first end 22, and to ensure that profile of the arm base complement and blend with the first member.

The arm base 24 is secured to the first member by conventional means, such as by nut and bolt attachment 34. The arm base 24 can be fabricated by any conventional material that is suitable for providing a secure attachment with the gate arm attachment means of the vehicle barrier device (see FIG. 1). In an example embodiment, the arm base 24 is formed from a polymer material such as polypropylene to facilitate attachment to the gate arm attachment means by clamp attachment.

The first assembly member 20 has a second end 36 that includes means for accommodating a breakable member 38 therein. In an example embodiment, the second end 36 includes a slot 40 that extends a distance towards the first end 22. The slot 40 has a depth and width sized to accommodate placement of a portion of the breakable member 38 therein. It is to be understood that the use of the slot is but one method of accommodating placement of the breakable member 38 within the first assembly member 20, and that other methods can be used and are intended to be within the scope of this invention. For example, the first assembly member 20 can be configured having another cutout portion located at the second end 36. In such embodiment, the breakable member 38 could be interposed between the new cutout portion and a plate positioned at an opposite surface of the breakable member.

In an example embodiment, for use in a particular application, the first assembly member 20 is approximately 10 centimeters long, approximately 8 centimeters wide, has cut out portion 30 that is approximately 5 centimeters long, and has a shoulder 28 that is approximately 1½ inches thick. The first assembly member has a slot 40 that is approximately 4 centimeters deep and that is approximately 7 millimeters thick.

The first assembly member 20 includes means for releasibly locking the breakable member 38 within the slot 40. In an example embodiment, such means is in the form of holes 42 that extend through the first assembly member 20 and slot 40, and pins 44 that are disposed through the holes 42. In a preferred embodiment, the first assembly member 20 includes a pair of holes 42 that are positioned vertically (with reference to FIG. 2) relative to one another, and a pair of clevis pins 44 disposed therethrough. The clevis pins 44 are used to facilitate releasible locking attachment with the first assembly member without the need to use tools. However, conventional attachment means, such as the use of nut and bolt, can alternatively be used.

As best illustrated in FIG. 3, the breakable member 38 is generally in the shape of a rectangle, having holes 45 disposed therein to accommodate placement of the clevis pins 44 therethrough. It is desired that the breakable member be formed from a material that is both capable of supporting the weight load of the gate arm without breaking, but breaking when exposed to a sufficient horizontal force imposed by a vehicle impacting the gate arm. Suitable materials used for forming the breakable member include wood, plastic, and composites such as fiber-reinforced resin materials. In an example embodiment, the breakable member 38 is formed from fiberglass-reinforced composite. Ultimately, the type of material selected will depend on the particular application and such factors as gate arm length, gate arm weight, gate arm size, and wind effects. Typically, it is necessary to use a stronger material for forming the breakable member when the application includes a long gate arm and/or is subject to high wind effects. In an example embodiment, for use in a particular application, the breakable member 38 is approximately 9 centimeters long, 8 centimeters wide, and 6 millimeters thick.

Referring back to FIG. 2, if desired, the first assembly member 20 can include means for securing the breakable member 38 within the slot 40 that is independent of the releasibly locking means, e.g., the use of the holes and clevis pins. In an example embodiment, the first assembly member 20 includes a threaded hole 46 though one wall of the slot 40 to accommodate a set screw 48 therein. The set screw 48 is turned within the threaded hole 46 to engage an adjacent surface of the breakable member 38 within the slot 40 and thereby secure the breakable member therein to minimize or eliminate lateral space between the slot and breakable member. It is desired that such lateral space be minimized or eliminated to prevent the breakable member from wobbling within the slot due to wind effects or the like, which could cause the breakable member to crack or break prematurely.

The breakaway assembly 12 includes a second assembly member 50 that is configured identical to the first breakaway assembly member 20. Accordingly, FIG. 2 illustrates the second assembly member 50 as comprising elements having the same element reference numbers. However, the second assembly member first end 22, rather than being constructed to connect with the arm base 24, is constructed to be connected with a gate arm 57 (as shown in FIG. 1). The gate arm is constructed in a complementary manner to provide a secure fit with the second member 50, and is fixedly attached thereto by nut and bolt attachment. The gate arm can be formed from any conventional structurally rigid material, such as, metal, metal alloy, plastic, and composite.

The breakable member 38 is interposed within the slot 40 of the second assembly member 50 so that it extends between both first and second assembly members 20 and 50. The breakable member 38 is designed having a length that is greater than the depth of both slots, so that a portion of the breakable member remains exposed between the first and second assembly members. It is desired that a portion of the breakable member 38 remain exposed, and unsupported by either assembly member, to provide a designated area for breakage. To facilitate a controlled breakage of the breakable member at a designated portion it may be desirable to provide an indentation or stress riser running vertically across one or each opposed surface at the middle of the breakable member. A breakable member 38 constructed in this manner will provide a controlled break, when the gate arm is subjected to an impact force, along the indentation. In an example embodiment, as illustrated in FIG. 3, the breakable member has an indentation 52 running vertically across each opposite surface along the middle of the breakable member. In an example embodiment, for use in a particular application, the middle portion of the breakable member 38 is exposed between the slots of each assembly member for a length of approximately 1½ centimeters.

The breakaway assembly 12, once installed into a gate arm in the manner described above, will brake at the breakable member 38 when the gate arm is subject to an impact of sufficient force. It is desired that the breakaway assembly function not break when the gate arm is subjected to insubstantial impacts or wind gusts. Therefore, the breakable member 38 is constructed to permit some degree of bending before reaching a designated breaking point. In an example embodiment, the brake member is tested to determine its brake rating by dropping a 12 pound weight onto the gate arm at different distances from the breakaway assembly. In an example application, it is desired that the breakable member break when a distance of 48 inches is reached. It is to be understood, however, that such break rating is for a particular application and will vary depending on the particular application variables, e.g., gate weight, gate size, gate dimensions, and wind effects. For example a higher brake rating would be desired in applications where the wind effects are high and/or the gate length is long, and a lower brake rating would be desired where the wind effects are low and/or the gate length is short.

Alternatively, more than one breakable member 38 can be installed within the gate arm. Such alternative use of the breakable member may be desirable, for example, in applications where the gate arm is long or where more than one break point is desired.

The breakaway assembly 12 may also include retaining means for keeping the first and second assembly members 20 and 50 loosely attached after the breakable member is broken. In an example embodiment, such means is in the form of a wire or cable 54 that is attached at opposite ends to a portion of respective first or second assembly members 20 or 50. The cable 54 is drawn loosely between the assembly members so as to not interfere with the break mechanism of the breakable member, yet to retain the second assembly member 50 and gate arm once the breakable member is broken. Such a retaining means is desirable to prevent the gate arm from being damaged, lost, or taken after it has been broken away.

Figure 4:
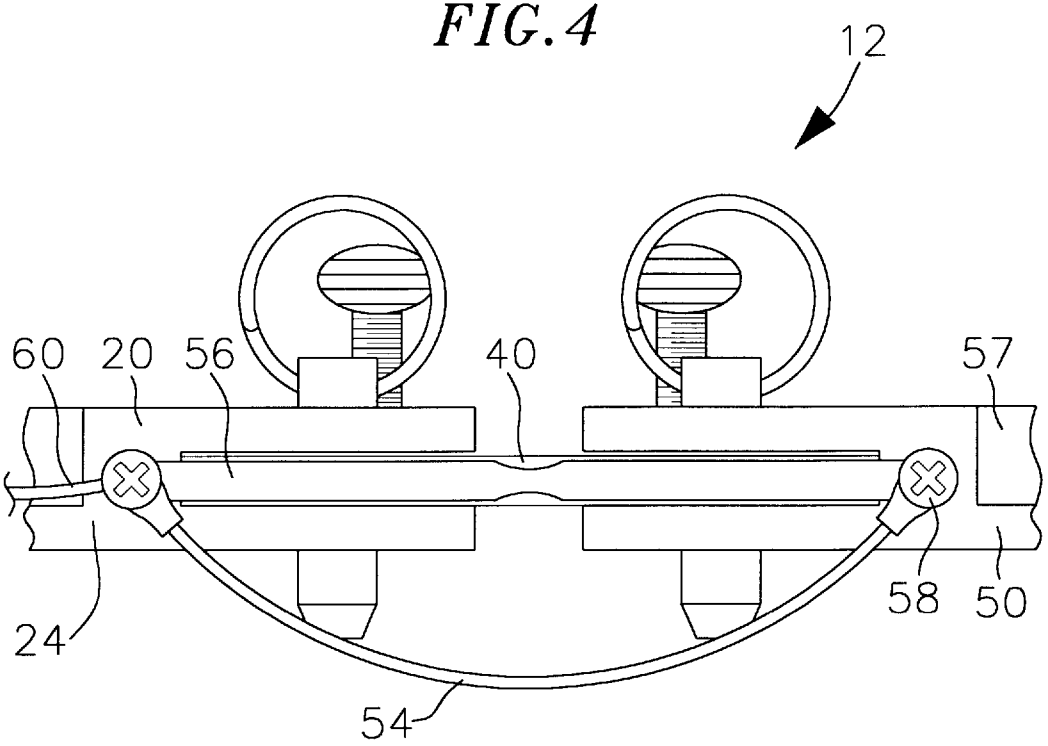
FIG. 4 is a bottom elevation view of the breakaway assembly of FIG. 2.

Additionally, the breakaway assembly 12 can be designed to accommodate means for providing a signal for activating an audible or visual indication in the even that the breakable member becomes broken. For example, referring to FIG. 4, the first and second attachment members 20 and 50 can be constructed to accommodate a rigid or flexible member 56 that is connected at opposite ends to conventional attachment means 58, such as screws and the like, that are used to connected the cable 54. The member 56 can be in the form of an electric wire, circuit board, or the like that closes or opens a circuit to produce a signal, that is sent to an alarm or visual indicator, when the breakable member 12 is broken. Accordingly, the member 56 includes an electrical connection 60, extending therefrom and away from the breakaway assembly 12, that is connected to a desired indication means (not shown). As illustrated in FIG. 4, the member 56 is disposed between the first and second attachment means so that it is affected upon the breaking of the breakable member.

A key feature of the breakaway assembly of this invention is that it enables easy and rapid repair after the second assembly member 50 and gate arm have been broken away. The breakaway assembly is designed so that an operator can repair it within a matter of minutes without having to use special tools, and without the need for assistance from others. Once broken, the breakaway assembly is repaired, and the gate arm is placed back into operation, by: (1) loosening any set screws 48 in each respective first and second assembly member 20 and 50; (2) removing each of the clevis pins 44 from the holes 42 in both assembly members; (3) removing the broken breakable member 38 portions from the slots 40 of the first and second assembly members; (4) placing one end of a new unbroken breakable member 38 into the slot 40 of either the first or second assembly member; (5) installing the clevis pins 44 through the holes 42 of such elected assembly member, and through the breakable member portion 38 within the slot to releasibly lock the breakable member within the slot; (6) positioning the remaining assembly member adjacent the breakable member 38 so that the exposed end of the breakable member is placed within such remaining assembly member slot 40; (7) installing the clevis pins 44 through the holes 42 of such remaining assembly member to releasibly lock the breakable member within its slot; and (8) tightening any set screws 48 in both assembly members to secure the breakable member within each slot.

It is to be understood that the above description of a breakaway assembly of the present invention is provided for illustrative purposes, and can be embodied other than that specifically described and illustrated. Because of variations which will be apparent to those skilled in the art, the present invention is not intended to be limited to the particular embodiments described above. The scope of the invention is defined in the following claims.

I claim:

1. A breakaway assembly including gate arm for use with a vehicle barrier device, the breakaway assembly comprising:

a first assembly member adapted to connect at one end with a movable member of a vehicle barrier device;

a second assembly member adapted to connect at one end with a gate arm of a vehicle barrier device; and a breakable member releasibly connected at one end to the first assembly member and releasibly connected at an opposite end to the second assembly member, wherein the breakable member is constructed to break between the first and second assembly members in response to a determined impact force imposed on the gate arm, wherein the first assembly member includes a slot, at an end opposite from the end connected to the movable member of the vehicle barrier device, that houses a portion of the breakable member therein.

2. The breakaway assembly as recited in claim 1 wherein the breakable member is releasibly connected within the slot of the first assembly member by pins extending through the first assembly member, the slot, and the breakable member.

3. The breakaway assembly as recited in claim 1 wherein the second assembly member includes a slot, at an end opposite from the end connected to the gate arm, that houses a portion of the breakable member therein.

4. The breakaway assembly as recited in claim 3 wherein the breakable member is releasibly connected within the slot of the first assembly member by pins extending through the second assembly member, the slot, and the breakable member.

5. The breakaway assembly as recited in claim 1 wherein each of the first and second assembly members further include means for securing the breakable member therein to prevent lateral wobble.

6. The breakaway assembly as recited in claim 1 further comprising means for retaining the first and second assembly members together after the breakable member has broken.

7. The breakaway assembly as recited in claim 1 further comprising means for providing a signal indicating that the breakable member has been broken.

8. A breakaway assembly including a vehicle gate arm, the breakaway assembly comprising:

a first assembly member that is connected at one end to a vehicle gate arm operating mechanism, the first assembly member having a slot extending therein at an opposite end;

a breakable member having a first end portion disposed within the slot and releasibly attached to the first assembly member;

a second assembly member that is connected at one end to a vehicle gate arm, and that includes a slot extending therein at an opposite end, wherein the breakable member has a second end portion disposed within the slot of the second assembly member and releasibly attached thereto;

wherein at least a portion of the breakable member is exposed and not disposed within a slot; and wherein the breakable member is constructed to break in response to a determined impact force imposed onto the gate arm.

9. The breakaway assembly as recited in claim 8 further comprising pins disposed through the first and second member, and through respective slots, to releasibly attach the respective breakable member portion therein.

10. The breakaway assembly as recited in claim 9 further comprising means for securing each breakable member portion within respective slots to prevent lateral wobble.

11. The breakaway assembly as recited in claim 8 wherein the breakable member is formed from a material selected from the group consisting of metals, metal alloys, plastics, and composites.

12. The breakaway assembly as recited in claim 8 further comprising means for retaining the first and second assembly members together in the event that the breakable member is broken.

13. The breakaway assembly as recited in claim 8 further comprising a member connected between first and second assembly members and adapted to provide a signal upon breaking of the breakable member.

14. A breakaway assembly including a gate arm comprising:

a first assembly member that is adapted to connect at one end to a gate arm operating mechanism, the first assembly member having a slot extending therein at an opposite end;

a breakable member having a first end portion disposed within the slot; a second assembly member that is connected at one end to a arm, and that includes a slot extending therein at an opposite end, wherein the breakable member has a second end portion disposed within the slot of the second assembly member;

wherein the first and second assembly members each comprise pins that extend therethrough, through respective slots, and through respective portions of the breakable member to provide a releasibly locking attachment therewith;

wherein at least a portion of the breakable member is exposed and not disposed within a slot; and wherein the breakable member is constructed to be preferentially broken in response to a determined impact force imposed onto the gate arm.

15. A vehicle barrier device comprising:

an actuating mechanism housing having an actuating member extending therefrom;

a gate arm base connected to the actuating member;

a breakaway assembly interposed between the gate arm base and a gate arm, the breakaway assembly comprising:

a first assembly member attached at one of its ends to the gate arm base;

a second assembly member attached at one of its ends to the gate arm; and a breakable member interposed between and releasibly attached to the first and second assembly members, wherein the breakable member is constructed to be preferentially broken in response to a determined impact force imposed onto the gate arm;

wherein the first and second assembly members each include a slot disposed within ends opposite from that attached to the gate arm base and gate arm, respectively, and wherein opposite end portions of the breakable member are disposed within a respective slot of the first and second assembly member.

16. A vehicle barrier device comprising:

an actuating mechanism housing having an actuating member extending therefrom;

a gate arm base connected to the actuating member;

a breakaway assembly interposed between the gate arm base and a gate arm, the breakaway assembly comprising:

a first assembly member attached at one of its ends to the gate arm base;

a second assembly member attached at one of its ends to the gate arm; and a breakable member interposed between and releasibly attached to the first and second assembly members, wherein the breakable member is constructed to be preferentially broken in response to a determined impact force imposed onto the gate arm, wherein the first and second assembly members each include pins disposed therethrough, through respective slots in the first and second assembly members receiving the breakable member, and through respective end portions of the breakable member to releasibly attach the breakable member to the first and second assembly members.

* * * * *